US005805966A

United States Patent [19]

Yamada

[11] Patent Number: 5,805,966

[45] Date of Patent: Sep. 8, 1998

[54] DEVELOPER LAYER FORMING DEVICE HAVING A BLADE PRESSED AGAINST A DEVELOPING ROLLER AT AN EDGE PORTION

[75] Inventor: Masanori Yamada, Ikoma, Japan

[73] Assignee: Sharp Kabushiki Kaisha, Osaka, Japan

[21] Appl. No.: 859,511

[22] Filed: May 20, 1997

[30] Foreign Application Priority Data

May 21, 1996 [JP] Japan ..... 8-125670

[51] Int. Cl.[6] ..... G03G 15/08

[52] U.S. Cl. ..... 399/284

[58] Field of Search ..... 399/274, 284

[56] References Cited

U.S. PATENT DOCUMENTS

| | | | |
|---|---|---|---|
| 4,760,422 | 7/1988 | Seimiya et al. | 399/284 |
| 4,923,777 | 5/1990 | Imai et al. | 430/120 |
| 4,990,959 | 2/1991 | Yamamuro et al. | 399/284 X |
| 5,085,171 | 2/1992 | Aulick et al. | 399/284 |
| 5,369,478 | 11/1994 | Kobayashi et al. | 399/284 X |
| 5,649,197 | 7/1997 | Fujita | 399/284 X |

FOREIGN PATENT DOCUMENTS

0309586 A1 5/1989 European Pat. Off. .

OTHER PUBLICATIONS

N. Ryoichi, "Electrostatic Latent Image Developing Device", Japanese Laid–Open Patent Publication No. 05107904, Published on Apr. 30, 1993.

European Search Report.

K. Kimura, et al., "Developer Layer Forming Device", Japanese Laid–Open Patent Publication No. 2–71284, Published on Mar. 9, 1990.

S. Kondo, "Developing Device", Japanese Laid–Open Patent Publication No. 58–169166, Published on Oct. 5, 1983.

K. Okano, et al., "Developing Device", Japanese Laid–Open Patent Publication No. 3–191370, Published on Aug. 21, 1991.

K. Nagaoka, et al., "Developing Device", Japanese Patent Publication No. 63–15580, Published on Apr. 5, 1988.

M. Hasoya, et al., "Developing Device", Japanese Patent Publication No. 3–20747, Published on Mar. 20, 1991.

*Primary Examiner*—William J. Royer

*Attorney, Agent, or Firm*—David G. Conlin; William J. Daley, Jr.

[57] ABSTRACT

A developer layer forming device includes a photoreceptor drum, a developing roller arranged opposite to the photoreceptor drum such that the developing roller is in contact with or adjacent to the photoreceptor drum, and supporting a non-magnetic developer, and a blade arranged opposite to the developing roller and also arranged such that an edge of the blade is pressed against and thus in contact with the developing roller at a nip portion.

9 Claims, 5 Drawing Sheets

DEVELOPER LAYER FORMING DEVICE HAVING A BLADE PRESSED AGAINST A DEVELOPING ROLLER AT AN EDGE PORTION

BACKGROUND OF THE INVENTION

1. Field of the Invention

The present invention relates to a developer layer forming device mounted on a developing device applicable to a copying machine, a printer, a facsimile machine and the like which form images by electronic photography, and in particular to a developer layer forming device wherein a non-magnetic developer on a developer supporting member is charged at a predetermined polarity and thus formed into a thin layer of uniform thickness.

2. Description of the Background Art

As a dry developing device which develops an electrostatic latent image in an electrophotographic image forming device, a two-component development method has been conventionally and generally used which employs a developer formed of toner and carrier. A typical two-component development method is a magnetic brush development method in which a magnetic field is generated to rise carrier and toner held on the surface of the carrier used for development. Such a magnetic brush development method using toner and carrier is sufficiently fit for practical use. Recently, however, for device miniaturization, easy maintenance due to use of a one-component developer consisting of toner only and the like, a one-component development method is broadly considered. In particular, non-magnetic toner which does not contain any magnetic material is more readily colored than magnetic toner and is actively researched. It has been conventionally important for a developing device using such a non-magnetic one-component developing method that a thin toner layer of uniform thickness on a developing roller is formed by a mechanism for forming a developer layer on a developer supporting member (referred to as a mechanism for controlling the thickness of a developer layer hereinafter).

Referring to FIG. 1, a mechanism for controlling the thickness of a developer layer in a developing device described in Japanese Patent Publication No. 63-15580 includes a developing roller 25 as a developer supporting member for forming an electrostatic latent image on a photoreceptor drum 1 as an image supporting member, a blade 281 having a surface formed of a soft elastic body of rubber, plastic or the like in contact with developing roller 25, a springy, thin plate spring 31 of metal or the like which is normally biased such that a midsection of blade 281 abuts on developing roller 25. In this mechanism, the thickness and uniformity of the toner layer affects development characteristics and thus it is important to obtain a uniform contact pressure of the mechanism for controlling the thickness of a developer layer on developing roller 25. Thus, the surface of a midsection of blade 281 can come into contact with developing roller 25 to maintain a uniform contact pressure. Furthermore, with such a configuration, a uniform, thin toner layer can be formed on developing roller 25 without depending on mechanical precision of parts or high precision of assembling.

Referring to FIG. 2, in a developing device described in Japanese Patent Publication No. 3-20747, an electrostatic latent image 10 is formed on a photoreceptor drum 1 as an image supporting member which is rotated in the direction of arrow A at a predetermined rotation speed. Positioned opposite to photoreceptor drum 1 with a gap g interposed is a developing roller 25 as a developer supporting member which is rotatably supported by an axis 32 and rotated in the direction of arrow B at a predetermined speed. Developing roller 25 is pressed by and thus in contact with a blade 281 as a mechanism for controlling the thickness of a developer layer. Axis 32 is provided with a switch 33, developing roller 25 can be grounded to obtain a less fogged image, and a power source 34 can be used to apply AC bias so that the flight efficiency of toner 3 as a developer is improved.

Blade 281 has one end held by a holder 301 and has a midsection portion pressed against and thus in contact with developing roller 25. Developing roller 25, blade 281 and holder 301 are arranged in a developing device within a case 35 which stores toner 3. A lower end of case 35 is sealed by a seal member 36 or the like. Furthermore, developing roller 25 is pressed by and thus in contact with a scraper member 37 which scrapes off adhering toner 3 so that new toner 3 is continuously supplied onto a surface of developing roller 25. As developing roller 25 is rotated in the direction of arrow B, toner 3 is moved, in time, between blade 281 and developing roller 25 while resisting the contact pressure of blade 281, during which toner 3 is charged at a predetermined polarity by frictional electrification and thus formed into a uniform thin layer.

Referring to FIG. 3, a mechanism for controlling the thickness of a developer layer in a developing device described in Japanese Patent Laying-Open No. 2-71284 is formed of a holder 301 as a support, a compressive elastic member 291 and a blade 281. Holder 301 and compressive elastic member 291 are coupled to compressive elastic member 291 and blade 281, respectively, by binding their entire opposite surfaces. The mechanism for controlling the thickness of a developer layer presses toner 3 as a developer by developing roller 25 as a developer supporting member and by the surface of a midsection of blade 281. As developing roller 25 is rotated in the direction of the arrow in the figure, toner 3 enters a wedge-shaped space formed by the surface of the midsection of blade 281 and a circumferential surface of developing roller 25, pushes up blade 281 and moves between blade 281 and developing roller 25, during which toner 3 is charged at a predetermined polarity by frictional electrification and thus formed into a uniform thin layer.

Japanese Patent Laying-Open No. 58-169166 discloses a configuration in which a rigid blade abuts on a developing roller having an elastic layer to form a developer layer.

In accordance with the configuration disclosed in Japanese Patent Laying-Open No. 3-191370, when an edge portion of the blade is adapted to come into contact with the developing roller, the edge portion vibrates and flatters with the rotation of the developing roller and thus the edge of the blade is adapted to slightly project from the rear edge of the nip to reduce toner scattering from the edge of the blade.

A difference between development using non-magnetic one-component toner and development using magnetic one-component toner will now be described. Conventionally, a developing device using non-magnetic one-component toner has a more significant challenge to address in forming a thin toner layer on a developing roller than a developing device using magnetic one-component toner. More specifically, a developing device using magnetic one-component toner uses a developing roller referred to as a magnetic roller which contains a magnetic pole to hold toner on a surface of the developing roller by magnetic force, electrostatic force and physical force (van der Waals force, for example). On the other hand, a developing device using non-magnetic one-component toner cannot use magnetic force and holds toner only by electrostatic and physical forces and thus the adhering ability of the toner on the developing roller is reduced. Consequently, the thickness of the toner layer is not uniform and problems such as degradation of image quality and contamination of the interior of the device due to toner scattering and the like are caused.

To solve the problems, a toner layer in which an excess of toner does not adhere to the developing roller, i.e., a toner layer of extremely thin one to two or three layers (approximately 7$\mu$–20 $\mu$m) of toner particles must be formed. Thus, systems conventionally used require a specialized step of increasing the pressurizing force of the blade or the like to eliminate unevenness of a toner layer and form a uniform thin layer.

Furthermore, when the conventional configurations shown in FIGS. 1–3 described above are applied, the surface of a midsection of blade 281 as the member for controlling the thickness of a developer layer is pressed against and thus in contact with developing roller 25 as the developer supporting member and thus the distribution of contact pressure at a nip portion as the contact portion between blade 281 and roller 25 exhibits a broad distribution. This will be described with reference to FIG. 4 showing a graph of a distribution of contact pressure at the nip portion when a midsection of a mechanism for controlling the thickness of a developer layer conventionally abuts on a developer supporting member. In the graph shown in FIG. 4, the vertical axis represents the contact pressure at the nip portion between blade 281 and developing roller 25 and the horizontal axis represents the direction of movement of developing roller 25 from upstream to downstream according to the rotation of developing roller 25 in the direction of arrow C. As shown in FIG. 4, the contact pressure at the nip portion is the largest at the center of the nip portion and is reduced near the upstream or downstream in the direction of the rotation of developing roller 25, thus exhibiting a broad distribution.

To form toner 3 into a uniform thin layer on developing roller 25, the largest value of the contact pressure need be increased. The contact pressure distribution is, however, broad as shown in FIG. 4 and thus the pressure applied to developing roller 25 of the mechanism for controlling the thickness of a developer layer need be increased. Consequently, the torque caused by driving developing roller 25 is disadvantageously increased, and downsizing the device is difficult to achieve due to increase of rigidity of the device.

Furthermore, when the largest value of the contact pressure described above is increased, a blade 281 of a low abrasion-resistant material such as silicone rubber would be rapidly abraded and thus the lifetime of the entire developing device is disadvantageously reduced.

In the configuration disclosed in the Japanese Patent Laying-Open No. 58-169166 described above, the developing roller on which a toner layer is formed is also significantly deformed and the blade of a rigid body is not deformed. Thus, while deformation of a toner layer itself on the developing roller, which is essentially required, is caused, unevenness of a toner layer is generally readily caused for significant deformation of the toner layer itself and causes uneven density in printing halftone images or the like.

SUMMARY OF THE INVENTION

One object of the present invention is to provide a developer layer forming device capable of stably forming a developer layer into a thin layer of uniform thickness when reduced pressure is applied to a developer supporting member in a non-magnetic one-component development method.

Another object of the present invention is to reduce the torque caused by driving a developing roller and achieve downsizing of a driving motor and reduction in power consumption.

In an aspect of the present invention, a developer layer forming device includes a photoreceptor drum, a developing roller arranged opposite to the photoreceptor drum such that the developing roller is in contact with or adjacent to the photoreceptor drum, and supporting a non-magnetic developer, and a blade arranged opposite to the developing roller and having an edge pressed against and thus in contact with the developing roller at a nip portion therebetween.

Since an edge of the blade is pressed against and thus in contact with the developing roller, the contact pressure at the edge attains the largest value. Thus when the pressure applied by the blade on the developing roller through the pressuring by and contact with the blade is reduced, the thickness of the developer is not uneven and degradation of image quality and contamination of the interior of the device due to scattering of the developer and the like are not caused and thus a developer layer can be formed into a thin layer of uniform thickness. This allows reduction in the torque caused by driving the developing roller, miniaturization of a driving motor and reduction in power consumption, and miniaturization of the device itself can be achieved without increasing the rigidity of the device, as is conventional.

In another aspect of the present invention, a developer layer forming device includes an image supporting member supporting an electrostatic latent image on a surface thereof and rotating in a predetermined direction, a developer supporting member arranged opposite to the image supporting member such that a surface of the developer supporting member is in contact or adjacent to a surface of the image supporting member, and rotating in a direction different from the predetermined direction while supporting a non-magnetic developer for developing on the surface of the developer supporting member an electrostatic latent image on the image supporting member, and a portion for controlling the thickness of a developer layer, pressing and thus in contact with a developer supported on a surface of the developer supporting member to charge the developer at a predetermined polarity and form the developer into a thin layer of uniform thickness. The portion for controlling the thickness of a developer layer has an elastic body at a surface thereof opposite to a surface of the developer supporting member, and the nip portion between the elastic body and the developer supporting member caused by pressuring and contact is adapted to include an edge portion of the elastic body closer to the downstream side of the elastic body with respect to the direction of the rotation of the developer supporting member. The pressuring by and contact with the elastic body at the edge portion allows the contact pressure at the nip portion applied on the developer and the surface of the developer supporting member to be the largest at the end portion of the elastic body closer to the downstream side of the elastic body with respect to the direction of the rotation of the developer supporting member.

A nip portion between an elastic body of a portion for controlling the thickness of a developer layer and a developer supporting member is adapted to include an edge portion of the elastic body closer to the downstream side of the elastic body with respect to the direction of the rotation of the developer supporting member. The pressuring by and contact with the edge portion of the elastic body allows the contact pressure at the nip portion applied to the developer and the surface of the developer supporting member to be the largest at the end portion of the elastic body closer to the downstream side of the elastic body with respect to the direction of rotation of the developer supporting member.

Thus, when the pressure applied to the developer supporting member through pressuring by and contact with the elastic body is reduced, the thickness of the developer is not uneven, a developing device can be provided in which problems such as degradation of image quality and contamination of the interior of the device due to toner scattering and the like are not caused, and a developer layer can be stably formed in a thin layer of uniform thickness. This allows reduction in the torque caused by driving the developer supporting member, miniaturization of a driving motor and reduction in power consumption can be achieved, and miniaturization of the device itself can be achieved without, as is conventional, increasing the rigidity of the device.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

A developer layer forming device of an embodiment according to the present invention will now be described with reference to the figures. The developing device is described below with respect to a developing device used in an electrophotographic system and the entire configuration thereof is well known and thus mechanisms for steps other than development in an electrophotographic system, such as charging, exposure, transfer, cleaning, fixation and discharging, are neither shown nor described.

Figure 1:
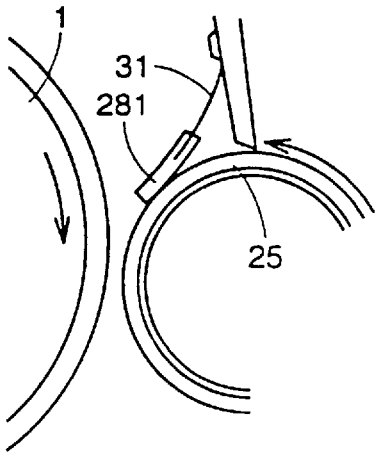
FIG.1 PRIOR ART
FIG. 1 shows a schematic configuration of a mechanism for controlling the thickness of a developer layer and a periphery thereof in a developing device described in Japanese Patent Publication No. 63-15580.
Figure 2:
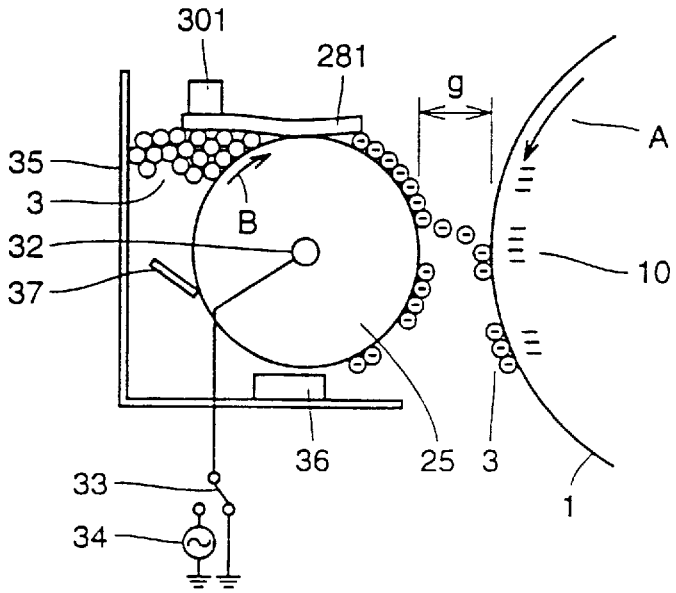
FIG.2 PRIOR ART
FIG. 2 shows a schematic configuration of a developing device described in Japanese Patent Publication No. 3-20747.
Figure 3:
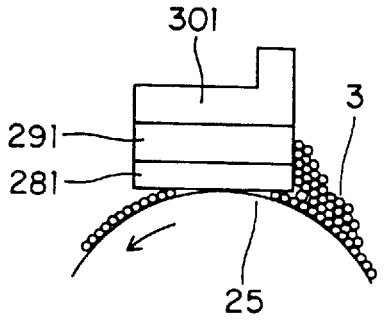
FIG. 3 PRIOR ART
FIG. 3 shows a schematic configuration of a mechanism for controlling the thickness of a developer layer and a periphery thereof in a developing device described in Japanese Patent laying Open No. 2-71284.
Figure 4:
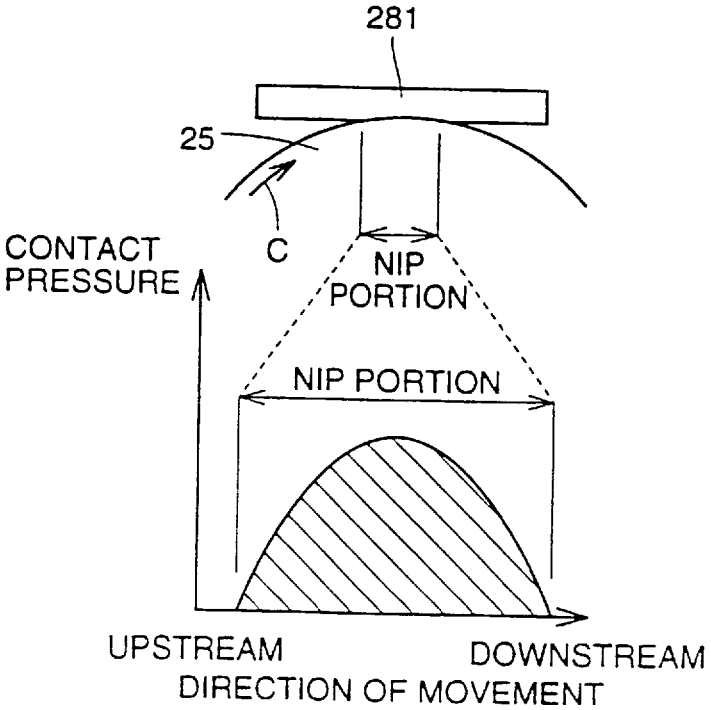
FIG. 4 PRIOR ART
FIG. 4 plots a distribution of contact pressure at a nip portion when, as is conventional, a midsection of a mechanism for controlling the thickness of a develop layer abuts on a developer supporting member.
Figure 5:
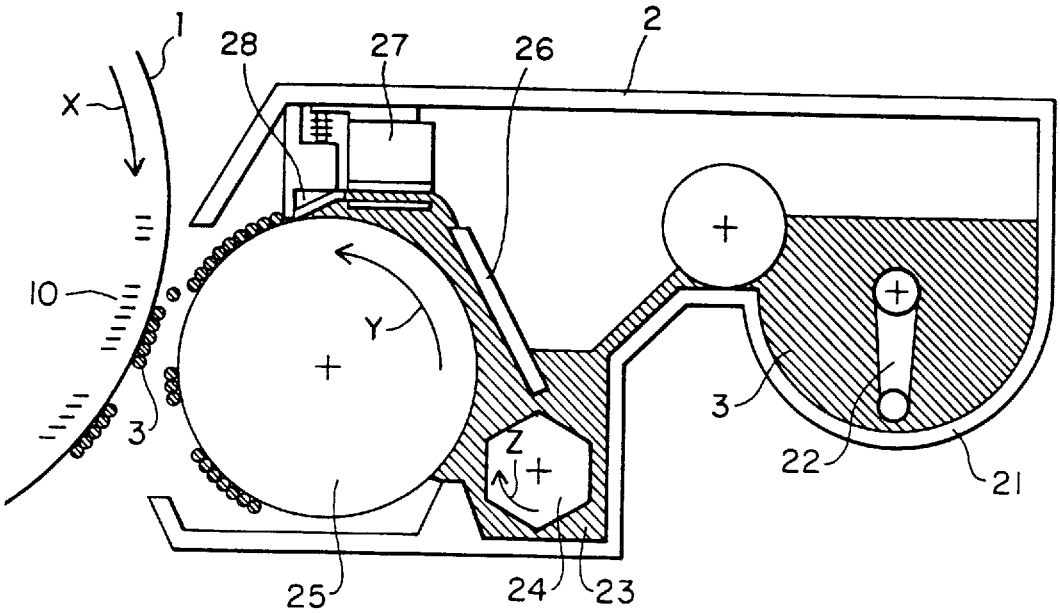
FIG. 5 shows a schematic configuration of a non-magnetic one-component developing device on which a developer layer forming device according to the present invention is mounted.

Referring to FIG. 5, a developing device 2 which develops an electrostatic latent image 10 on a surface of a photoreceptor drum 1 as an image supporting member by toner 3 includes a toner hopper 21 which stores toner 3, a paddle 22 which churns toner 3 in toner hopper 21, a developer tank 23 to which toner 3 churned by paddle 22 is supplied, a toner transporting roller 24 and a guide plate 26 which transport and thus supply toner 3 in developer tank 23 upward on a surface of a developing roller 25 as the developer supporting member, a guiding member 27 which appropriately controls the flow of toner 3, and a blade 28 as part of the developer layer forming device.

In operation, photoreceptor drum 1 can be rotated at a rotation speed of 86 mm/s–190 mm/s in the direction of arrow X in the figure, and the surface thereof is uniformly charged by a charging mechanism (not shown) and desired image information is recorded on the surface by an exposure mechanism (not shown) to form an electrostatic latent image 10. Photoreceptor drum 1 is formed of a cylindrical member of aluminum with the surface coated with a thin layer of an organic photoreceptor material and has a diameter of the cylindrical member of 50 mm and a thickness of the organic photoreceptor layer of 20 $\mu$m–25 $\mu$m in the present embodiment.

As photoreceptor drum 1 is rotated, the electrostatic latent image 10 is moved to a developing area opposite to developing device 2 and is developed by toner 3. Toner adhering to a surface of photoreceptor drum 1 is then transferred by a transfer mechanism (not shown) onto a transferring material such as paper. After the separation from photoreceptor drum 1, toner 3 on the transferring material is fixed on the transferring material by a fixation mechanism (not shown). After transfer, photoreceptor drum 1 has its surface cleaned by a cleaning mechanism (not shown) and then has any electric hysteresis that remains on its surface removed by a discharging mechanism (not shown).

In developing device 2, positively charged non-magnetic one-component toner 3 stored in toner hopper 21 which has an average particle diameter of 5 $\mu$m–10 $\mu$m and a composition of styrene-acrylic copolymer of 80%–90%, carbon black of 5%–10%, $SiO_2$ as an added agent of 0.5%–1.5%, and a charge control agent of 0%–5%, is churned by paddle 22 and supplied to developer tank 23. As a toner transporting roller 24, formed of a resin material such as ABS or a metal material such as aluminum alloy and stainless steel, is rotated in the direction of arrow Z in the figure, the toner 3 supplied to developer tank 23 is churned and also supplied to developing roller 25.

A rigid body of a diameter of 20 mm with a surface of aluminum processed by sandblasting or the like to have an average roughness Ra of approximately 0.1 $\mu$m–1.5 $\mu$m at the center line, which is defined according to JISB0601, was used for developing roller 25. As developing roller 25 is rotated in the direction of arrow Y in the figure at a rotation speed of 77 mm/s–230 mm/s, the toner 3 supplied by toner transporting roller 24 passes between metal guide plate 26 of aluminum alloy, stainless steel or the like and a surface of developing roller 25 and is transported upward. The flow of toner 3 is appropriately controlled by guiding member 27 and rushes toward blade 28. Guiding member 27 is constituted of a compressive elastic member of a foaming material such as urethane sponge or silicone sponge fixed by adhesion or the like to a metal bar of aluminum alloy, stainless steel or the like. Blade 28 forms toner 3 on a surface of developing roller 25 into a film of a thin layer having a uniform thickness of approximately 10 $\mu$m–20 $\mu$m and an adhering amount per unit area of 0.5 mg/cm$^2$–0.8 mg/cm$^2$, which is transported with rotation of developing roller 25 to a developing area at which photoreceptor drum 1 is opposite to developing roller 25, and is developed according to electrostatic latent image 10 on photoreceptor drum 1, as described above.

Figure 6:
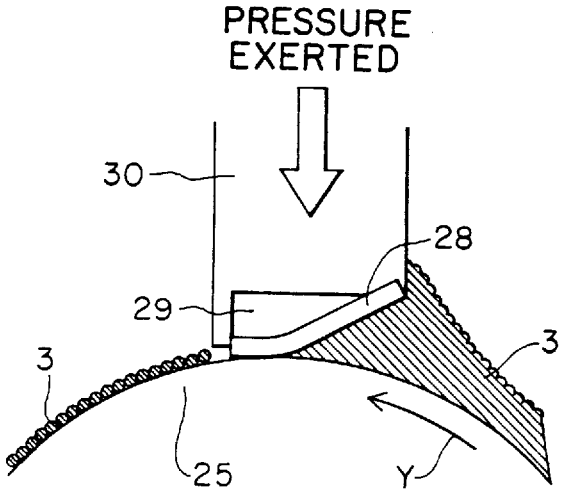
FIG. 6 shows a schematic configuration of the developer layer forming device shown in FIG. 5.

Referring to FIG. 6, a developer layer forming device is constituted of a photoreceptor drum 1, a developing roller 25, and a holder 30, a compressive elastic member 29 and a blade 28 as a mechanism for controlling the thickness of a developer layer. Compressive elastic member 29 is formed of urethane sponge (marketed under the trademark of ZUREN, Ascar-C hardness:40°), and blade 28 is formed of urethane rubber (JIS-A hardness:65°) and formed into a plate or block. Holder 30, compressive elastic member 29 and blade 28 are fixed together by adhesion or the like at the entirety of their opposing surfaces. The developer layer forming device is pressurized by a compression spring (not shown) exactly above holder 30 with a pressure per unit length in the axial direction of developing roller 25 (referred to as a linear load of the blade hereinafter) of approximately 50 gf/cm–120 gf/cm.

The toner 3 transported with rotation of developing roller 25 has its flow dammed up by the developing layer forming device and is stored into a wedge-shaped space formed by opposite surfaces of blade 28 and developing roller 25. Toner 3 is successively supplied into the wedge-shaped space and creates a pressure which pushes blade 28 upward and thus while toner 3 passes through the nip portion between blade 28 and developing roller 25, toner 3 is formed into a thin toner layer provided with an electrical charge of a desired polarity by frictional electrification.

It is noted that a material constant of blade 28 is a JIS-A hardness of 60°–80°, preferably 65°–75°. Furthermore, the Young's modulus is 50 kg/cm$^2$–70 kg/cm$^2$, preferably 55 kg/cm$^2$–60 kg/cm$^2$.

Furthermore a material constant of compressive elastic member 29 is an Ascar-C hardness of 10°–60°, preferably 15°–40°.

Figure 7:
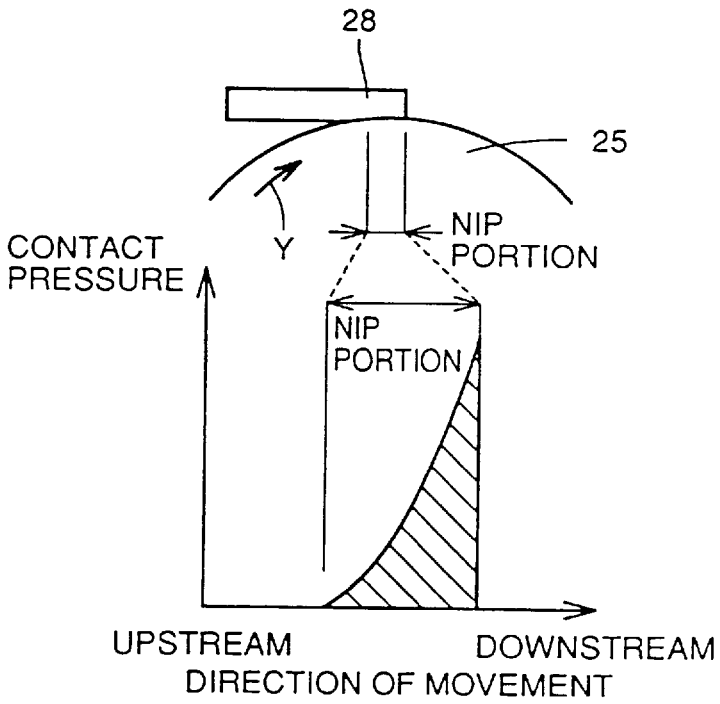
FIG. 7 plots a distribution of contact pressure at a nip portion when a midsection of the mechanism for controlling the thickness of a developer layer shown in FIG. 6 abuts on a developer supporting member.

Contact pressure distribution at the nip portion in a structure such as shown in FIG. 6 will be described. Referring to the graph shown in FIG. 7, the vertical axis represents the contact pressure at the nip portion between blade 28 and developing roller 25, and the horizontal axis represents the direction of movement of developing roller 25 from upstream to downstream according to the rotation of developing roller 25 in the direction of arrow Y. For the mechanism for controlling the thickness of a developer layer shown in FIG. 6, the contact pressure starts to increase at the nip portion closer to the upstream and reaches the largest value at that end portion closer to the downstream at which an edge portion of blade 28 abuts on the developing roller 25, as shown in FIG. 7. Thus, the toner 3 which enters the nip portion is gradually regulated according to the contact pressure distribution. The thickness of the toner layer is most effectively regulated at that point at which the contact pressure at the nip portion reaches the largest value. Accordingly, for a same integration value of the contact pressure at the nip portion, i.e., a same pressure exerted by the entire blade, the largest value of the contact pressure is larger when an edge portion of blade 28 is that end portion of the nip portion closer to the downstream, as shown in FIG. 7, than when a midsection of blade 281 forms the nip portion and thus a broad distribution of the contact pressure results. In other words, for a contact pressure having a same largest value, an edge portion of blade 28 is adapted to abut on that end portion of the nip portion closer to the downstream, as is in the present embodiment, to contemplate reduction of the pressure exerted by the blade.

In contrast to the present embodiment, when the contact pressure distribution at the nip portion reaches the largest value at the upstream, that is, when an edge portion of the blade is adapted to abut on that end portion of the nip portion closer to the upstream, a toner layer is hardly formed.

Toner 3 film formation in a developing device according to the present embodiment will now be compared with that in a developing device described in Japanese Patent Laying-Open No. 2-71284. The toner 3 film formation was observed by rotating developing roller 25 and visually observing the uniformity of the thickness of toner 3 after toner 3 passes blade 28 (281). The rotation speed of developing roller 25 is 30 mm/s. An evaluation reference for uniformity of the thickness of toner 3 is as follows:

Grade 5: an uneven thickness of the toner layer not found

Grade 4: between grade 5 and grade 3

Grade 3: an uneven thickness of the toner layer found partially in the direction of the axis of the developing roller Grade 2: between Grade 3 and Grade 1

Grade 1: a significantly uneven thickness of the toner layer found entirely in the direction of the axis of the developing roller.

Figure 8:
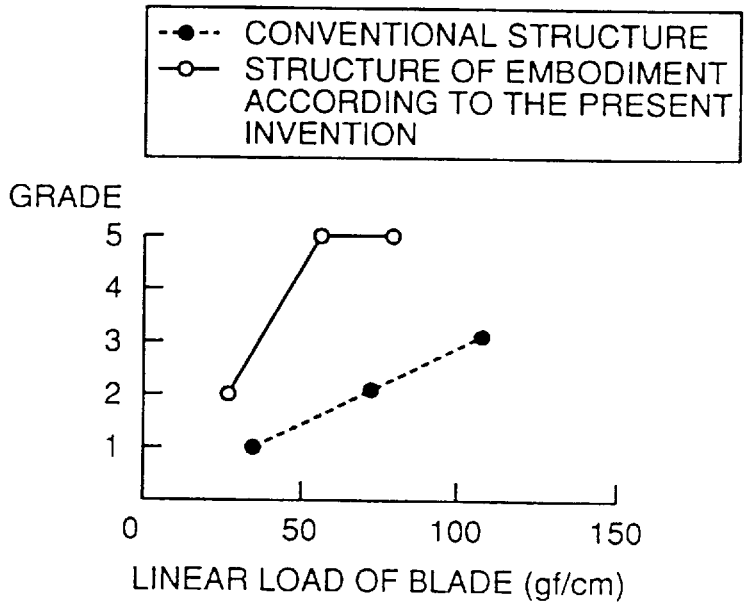
FIG. 8 plots uniformity of the thickness of toner with respect to linear load of the blade of the mechanism for controlling the thickness of a developer layer of an embodiment according to the present invention as compared with a conventional example

Referring to the graph shown in FIG. 8, the vertical axis represents the above grades indicating uniformity in thickness of toner 3 visually observed and the horizontal axis represents linear load of the blade (gf/cm). The solid line in the figure represents the uniformity in thickness of toner 3 in a developer layer formation according to the present embodiment and the broken line represents the uniformity in thickness of toner 3 in a conventional developer layer formation described in Japanese Patent Laying-Open No. 2-71284.

As shown in FIG. 8, for a conventional developer layer formation mechanism described in Japanese Patent Laying-Open No. 2-71284, an uneven thickness of toner 3 is caused even for a linear load of the blade of 100 gf/cm or more, whereas a mechanism according to the present embodiment shown in FIG. 6 exhibits a good film formation without any uneven thickness of toner 3 even for a linear load of the blade of 50 gf/cm.

Figure 9A:
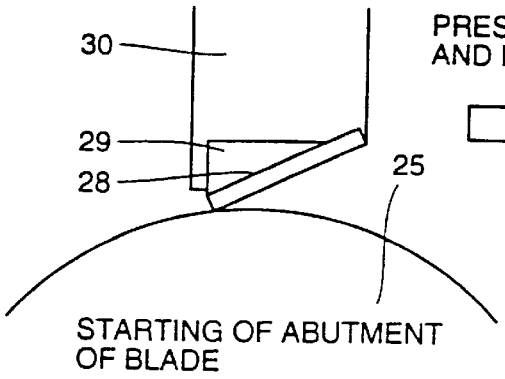
FIGS. 9A and 9B are views for illustrating a mechanism according to an embodiment of the present invention by which a blade abuts on a developing layer.
Figure 9B:
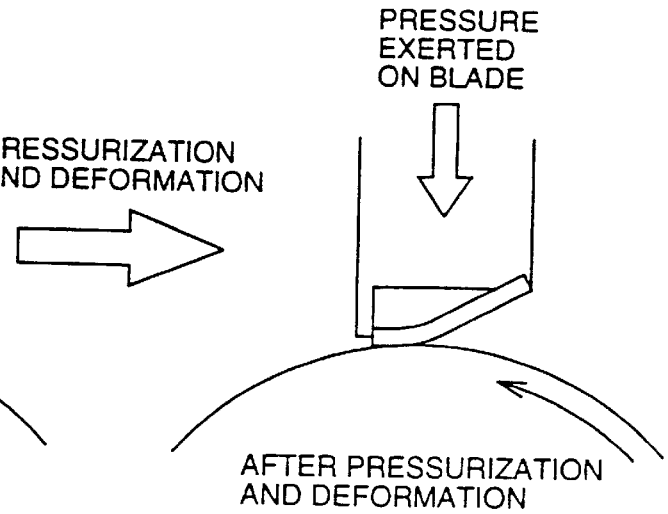

A mechanism according to the present invention will now be described in which blade 28 starts to abut at its edge closer to the downstream on developing roller 25. Referring to FIG. 9A, blade 28 is fixed to holder 30 with compressive elastic member 29 of urethane sponge disposed therebetween, and blade 28 is pressurized by a pressurizing mechanism such as spring (not shown) from exactly above holder 30. As shown in FIG. 9A, when blade 28 abuts on a surface of developing roller 25, blade 28 starts to abut on the surface of developing roller 25 at its edge portion closer to the downstream. As blade 28 is pressurized from exactly above holder 30, compressive elastic member 29 and blade 28 are elastically deformed, as shown in FIG. 9B. The contact pressure of blade 28 at that end portion of the nip portion closer to the downstream can be the largest by ensuring that an edge portion of blade 28 abuts on a surface of developing roller 25 at the end portion of the nip portion closer to the downstream.

Blade 28 has, for example, a width of 5 mm–12 mm, a length of 320 mm and a thickness of 1 mm–3 mm.

Figure 10:
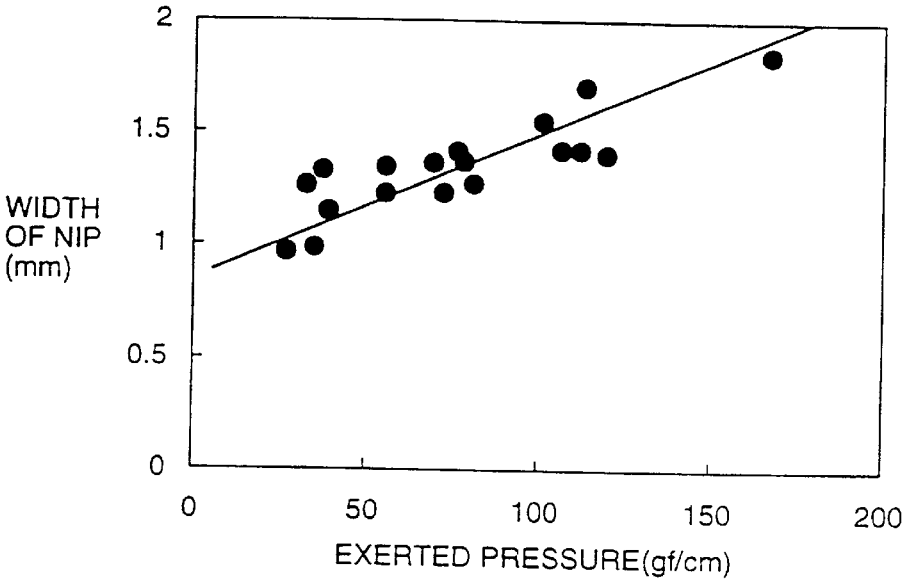
FIG. 10 plots a correlation between the width of the nip portion and the magnitude of pressure exerted in the mechanism for controlling the thickness of a developer layer shown in FIG. 6.

The width of the nip portion changes depending on the magnitude of the pressure exerted on the mechanism for controlling the thickness of a developer layer. Referring to FIG. 10, for a blade 28 having the dimensions mentioned above, the width and length of the nip portion according to an experiment are approximately 1 mm–2 mm and 320 mm, respectively.

The compressive elastic member 29 exemplified in the present embodiment is not limited to urethane sponge. Compressive elastic member 29 need only be of a material which exhibits compressive elasticity and may be of a foaming material such as acrylic foam, or a rubber material such as natural rubber, chloroprene rubber, urethane rubber, silicone rubber, fluoro rubber, nitrile rubber, styrene rubber or the like.

While the non-magnetic one-component toner 3 exemplified in the present embodiment is positively charged toner, it may be negatively charged toner and is applicable to black toner for monochrome copying machines and printers as well as color toner for color copying machines and printers.

Furthermore, non-magnetic one-component toner 3 is not limited to the composition mentioned above and may have such a composition as described below.

A thermoplastic resin as the main resin may be styrene-acrylic copolymer as well as polystyrene, polyethylene, polyester, polypropylene having a low amount of molecules, epoxy, polyamide, polyvinyl butyral or the like. The coloring agent may be carbon black as well as furnace black, a dye of nigrosine group, metal complex dye or the like. The color toner for yellow may be a yellow pigment of benzine group, phonon yellow, an insoluble azo pigment of acetoacetic acid anilide group, monoazo pigment, a coloring matter of azomethine group or the like. The color toner for magenta may be a magenta dye of xanthene group, phosphotungstic molybdic acid lake pigment, a dye of anthraquinone group, a coloring material consisting of a dye of xanthene group and organic carboxylic acid, thioindigo, an insoluble azo pigment of naphthol group or the like. The color toner for cyanogen may be a pigment of copper phthalocyanine group or the like. The added agent may be $SiO_2$ as well as colloidal silica, titanium oxide, alumina, zinc stearate, polyvinylidene fluoride or a mixture thereof. The charge control agent includes a material of nigrosine group, fatty acid metalic salt, amine, quaternary ammonium salt or the like for positively charged toner, and a dye of alloy of azo group, organic acid metal complex, chlorinated paraffin or the like for negatively charged toner.

Furthermore, a material for blade 28 exemplified in the present embodiment is not limited to urethane rubber and need only be an elastic material having superior abrasion resistance and, in particular, either nitrile rubber or fluoro rubber may be used.

As described above, since a mechanism for controlling the thickness of a developer layer according to the present embodiment has the blade 28 side formed of an elastic material, the surface of developing roller 25, more specifically, the toner layer itself is not deformed and thus unevenness in the toner layer is more difficult to result. Furthermore, for a developing roller 25 of a rigid body, as is in the present embodiment, the generation of unevenness in the toner layer is significantly restrained.

Furthermore, the configuration of the mechanism for controlling the thickness of a developer layer according to the present embodiment has compressive elastic member 29 disposed between blade 28 and holder 30 and thus vibration of an end of blade 28 is more effectively prevented and scattering of toner 3 is effectively reduced.

Furthermore, the configuration of the mechanism for controlling the thickness of a developer layer according to the present embodiment still allows formation of a thin layer if the pressure exerted onto blade 28 is reduced. Thus, a problem characteristic to development of non-magnetic one-component toner, which is not found with development of magnetic one-component toner, (i.e., toner is held by electrostatic force and physical force only and thus the adhering ability of the toner on the developing roller is reduced) can be solved.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A developer layer forming device comprising:

a photoreceptor drum;

a developing roller arranged opposite to said photoreceptor drum such that said developing roller is in contact with or adjacent to said photoreceptor drum, and supporting a non-magnetic developer; and a blade arranged opposite to said developing roller and also arranged such that an edge of said blade is vertically pressed against and thus in contact with a surface of said developing roller at a nip portion.

2. The developer layer forming device according to claim 1, wherein said blade is arranged such that a contact pressure at said nip portion reaches a largest value at that end of said blade closer to a downstream side of said blade with respect to a direction of rotation of said developing roller.

3. The developer layer forming device according to claim 1, wherein that surface of said blade pressed against and thus in contact with said developing roller is an elastic body.

4. The developer layer forming device according to claim 3, wherein that surface of said developing roller pressed by and thus in contact with said blade is a rigid body.

5. A developer layer forming device comprising:

an image supporting member supporting an electrostatic latent image on a surface thereof and rotating in a predetermined direction, a developer supporting member arranged opposite to said image supporting member such that a surface of said developer supporting member is in contact with or adjacent to a surface of said image supporting member, and rotating in a direction different from said predetermined direction while supporting a non-magnetic developer for developing on a surface of said developer supporting member said electrostatic latent image on said image supporting member, and means for controlling a thickness of a developer layer, for vertically pressing and coming into contact with said non-magnetic developer supported on the surface of said developer supporting member and thereby charging said non-magnetic developer at a predetermined polarity and forming said non-magnetic developer into a thin layer of uniform thickness, wherein:

said means for controlling the thickness of a developer layer has an elastic body at a surface thereof opposite to the surface of said developer supporting member, and a nip portion created by said elastic body and said developer supporting member due to said pressing and contact is adapted to include an edge portion of said elastic body closer to a downstream side of said means for controlling the thickness of the developer layer with respect to the direction of rotation of said developer supporting member; and said pressing and contact by said elastic body allows a contact pressure exerted on said non-magnetic developer and the surface of said developer supporting member at said nip portion to be the largest value at said end closer to the downstream side of said means for controlling the thickness of the developer layer with respect to the direction of rotation of said developer supporting member.

6. The developer layer forming device according to claim 5, wherein said means for controlling the thickness of a developer layer is pressed against and thus in contact with said developer supporting member, said means for controlling the thickness of a developer layers starts to be pressed against and thus in contact with the surface of said developer supporting member at said edge portion of said means for controlling the thickness of a developer layer positioned closer to the downstream side of said means for controlling the thickness of the developer layer with respect to the direction of rotation of said developer supporting member.

7. The developer layer forming device according to claim 5, wherein said means for controlling the thickness of a developer layer includes:

said elastic body;

a compressive elastic member formed on a surface of said elastic body opposite to a surface of said elastic body facing the surface of said developer supporting member; and a supporting member formed on a surface of said compressive elastic member opposite to a surface of said compressive elastic member having said elastic body formed thereon, and pressurized for said pressuring and contact from exactly above.

8. The developer layer forming device according to claim 5, wherein said elastic body is a highly abrasion-resistant rubber material.

9. The developer layer forming device according to claim 8, wherein said rubber material is any of urethane rubber, nitrile rubber and fluoro rubber.

* * * * *